United States Patent [19]

Holder

[11] Patent Number: 4,615,269

[45] Date of Patent: Oct. 7, 1986

[54] CONSTRAINED STEPPING MOTOR UNIQUE CODE DEVICE

[75] Inventor: James D. Holder, Huntsville, Ala.

[73] Assignee: The United States of America as represented by the Secretary of the Army, Washington, D.C.

[21] Appl. No.: 685,890

[22] Filed: Dec. 24, 1984

[51] Int. Cl.[4] ..... F42C 15/40

[52] U.S. Cl. ..... 102/221; 102/222; 102/254

[58] Field of Search ..... 102/221, 222, 254, 255

[56] References Cited

U.S. PATENT DOCUMENTS

| | | | |
|---|---|---|---|
| 3,667,342 | 6/1972 | Warnock et al. | 102/221 X |
| 3,667,392 | 6/1972 | Grantham et al. | 102/221 X |
| 3,955,508 | 5/1976 | Will et al. | 102/216 |
| 4,094,247 | 6/1978 | Schmidlin | 102/228 |
| 4,185,556 | 1/1980 | Keithley et al. | 102/212 X |
| 4,187,779 | 2/1980 | Jones et al. | 102/209 |
| 4,464,991 | 8/1984 | Kaiser | 102/255 X |

*Primary Examiner*—Peter A. Nelson

*Attorney, Agent, or Firm*—Anthony T. Lane; Robert P. Gibson; Harold W. Hilton

[57] ABSTRACT

A unique code device for use with explosive devices. A stepping motor is provided with a shaft for rotation a predetermined number of times for arming the explosive device. Magnetic damping (braking) means is provided to constrain rotation of the shaft.

2 Claims, 1 Drawing Figure

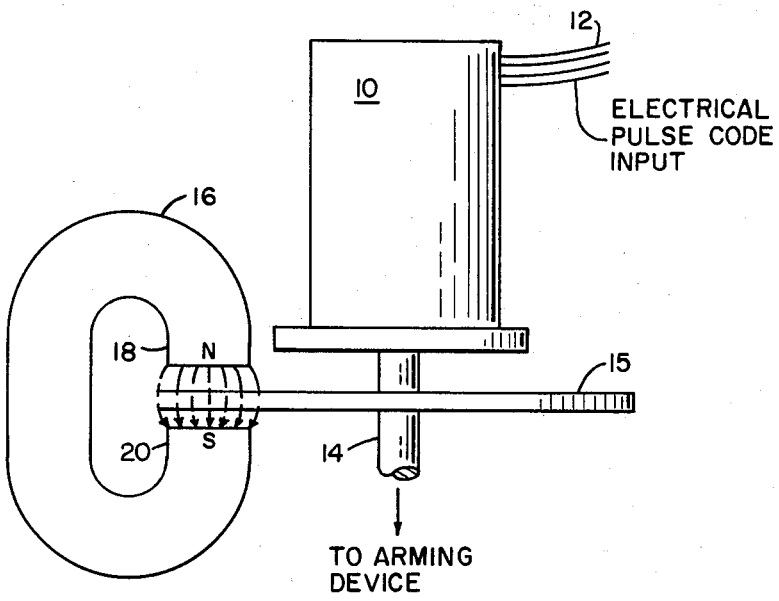
12
10
ELECTRICAL
PULSE CODE
INPUT
16
18
N
15
20
S
14
TO ARMING
DEVICE

CONSTRAINED STEPPING MOTOR UNIQUE CODE DEVICE

DEDICATORY CLAUSE

The invention described herein may be manufactured, used, and licensed by or for the Government for governmental purposes without the payment to ME of any royalties thereon.

BACKGROUND OF THE INVENTION

In the development of safe-and-arm (S&A) devices for the implementation of safety in the use of explosive devices, the "unique-code device" (UCD) concept has been developed by the ordnance dicipline. A UCD is a device which is, in essence, an electrically operated combination lock. This device is of such a design that no plausable abnormal environments could cause the proper signals or dispacements which could cause arming of the controlled ordnance device. This is normally done using a complex system of cams, ratchets, pawls, levers, and electromagnets. Such devices are, of course, very precision in manufacture to meet military reliability requirements, and are quite difficult to design and develop. Most such systems are very costly and have marginal reliability.

It would be quite preferred to decrease the mechanical complexity of the UCD to enhance the cost/reliability factors if the unique-coding can be retained. A candidate for such a device is the multi-phase DC stepping motor. This device is commonly used in positioning and movement in precision devices such as computer printers and is very simple and economical in design. With a proper phase-relationship input from a computer circuit or other switching means, the motor will turn in precise angular increments due to its basic design. If the phase-relationships are at other than the proper value, the action of the motor is perfectly predictable due to the interaction of the magnetic fields and pole-pieces within the motor. With proper mechanical stops installed, and the requirement of at least one full turn of the motor shaft for arming, the probability for erronious arming is 1 in 65,000,000 for the common four-phase stepping motor.

A possible problem with the use of only a stepping motor is the case of overdriving the stepping motor. In this instance, it may under some conditions, with some motors, be possible to cause the motor to take more than one increment at a time. This may be possible if the stored rotational inertia in the motor armature is comparable in force to the restraining holding torque value of the motor. The rotational inertia of the armature is proportional to the square of its rotational speed, thus if the motor is constrained to operate at low speeds—i.e., slow stepping rates—there will be insufficient stored torque in the armature to cause overrunning of the magnetic holding field. Implementation of this constraining method would be to use magnetic damping.

It is an object of the present invention therefore, to provide a device for arming a safe-and-arm mechanism only after valid commands have been issued to the device.

It is a further object of the present invention to proivide such a device in which magnetic damping is achieved by eddy current braking.

SUMMARY OF THE INVENTION

A unique code device for use on safe-and-arm devices such as a nuclear warhead. A stepping motor has its output shaft connected to the safe-and-arm device. A copper disk is secured to the shaft for rotation through a magnetic field provided by a permanent magnet. Magnetic damping (braking) is achieved by the magnetic field provided by the magnet.

BRIEF DESCRIPTION OF THE DRAWING

The FIGURE is an elevational view illustrating the magnetically constrained motor of the present invention.

DESCRIPTION OF THE PREFERRED EMBODIMENT

As seen in the FIGURE, a stepping motor 10 is provided with electrical leads 12 connected to a source which provides an electrical pulse code input. A shaft 14 extends from motor 10 to a device which is to be armed, such as a warhead. An eddy-current brake disc 15 is connected to shaft 14 and a permanent magnet 16 is positioned adjacent the disc with its north end 18 and south end 20 adjacent opposite sides of the disc.

The device of the present invention achieves magnetic damping by eddy-current braking. A conducting member 15 such as a copper disc, is attached to the motor shaft 14 and there is impressed a strong magnetic field through the disc by magnet 15. When the shaft turns there will be electrical currents generated within the disc. Since these currents close upon themselves in a short path within a low resistance media, a large current will flow. These currents generate a strong magnetic field and this field is of such a sense that it opposes the rotation, thus constraining the shaft. By using present day magnet materials such as sumarium-cobalt, small magnets of extreme strength may be made so that the magnetic constraint device need not increase the motor bulk unduly. The advantages of the magnetic damping is in its long life stability and reliability. The flux does not vary substantially with temperature of the normal military ranges, and the flux decays only at a very slow and quite predictable rate over a period of many years.

A constrained stepping motor design should, with proper attention to the code driving source, yield a UCD of the required safety with much greater reliability and much lower cost than any of the currently-used designs.

I claim:

1. Apparatus for implementation of safety in the use of explosive devices comprising:

a. a stepping motor having a shaft extending therefrom;

b. an arming device connected to said stepping motor;

c. an electrically conductive disc secured to said shaft for rotation therewith; and, d. magnetic means positioned adjacent said disc for impressing a magnetic field through said disc in a sense to oppose rotation of said shaft to achieve magnetic braking of said shaft said magnetic means being a permanent magnet having its respective ends adjacent opposite sides of said disc.

2. Apparatus as in claim 1 wherein said disc is copper.

* * * * *